US009440341B2

(12) United States Patent
Bell et al.

(10) Patent No.: US 9,440,341 B2
(45) Date of Patent: Sep. 13, 2016

(54) MAGNETIC FRAME AND GUIDE FOR ANTI-ROTATION KEY INSTALLATION

(71) Applicant: Vetco Gray Inc., Houston, TX (US)

(72) Inventors: Gregory Bell, Houston, TX (US); William Rey Patterson, Jr., Houston, TX (US)

(73) Assignee: VETCO GRAY INC., Houston, TX (US)

( * ) Notice: Subject to any disclaimer, the term of this patent is extended or adjusted under 35 U.S.C. 154(b) by 232 days.

(21) Appl. No.: 14/029,938

(22) Filed: Sep. 18, 2013

(65) Prior Publication Data

US 2015/0074979 A1 Mar. 19, 2015

(51) Int. Cl.

| | |
|---|---|
| ***B25B 27/04*** | (2006.01) |
| ***B25B 11/00*** | (2006.01) |
| ***E21B 17/043*** | (2006.01) |

(52) U.S. Cl.

CPC ..... *B25B 27/04* (2013.01); *B25B 11/002* (2013.01); *E21B 17/043* (2013.01); *Y10T 29/49902* (2015.01); *Y10T 29/5393* (2015.01); *Y10T 29/53983* (2015.01)

(58) Field of Classification Search

CPC ..... B25B 11/002; B23K 37/0435; B23Q 3/1543; H01H 59/00; H01H 3/28

See application file for complete search history.

(56) References Cited

U.S. PATENT DOCUMENTS

| | | | | |
|---|---|---|---|---|
| 2,844,357 A | | 7/1958 | Ring | |
| 3,105,550 A | | 10/1963 | Ehlert | |
| 3,182,724 A | | 5/1965 | Shore | |
| 3,198,904 A | | 8/1965 | Ehlert | |
| 4,058,166 A | | 11/1977 | Crickmer | |
| 4,219,773 A | | 8/1980 | Markfelt | |
| 4,438,810 A | | 3/1984 | Wilkinson | |
| 5,318,129 A | | 6/1994 | Wittrisch | |
| 5,512,889 A | | 4/1996 | Fletcher | |
| 5,947,051 A | | 9/1999 | Geiger | |
| 5,971,379 A | * | 10/1999 | Leon, Jr. | B25B 11/002 228/212 |
| 6,092,271 A | * | 7/2000 | Stojkovic | B25B 27/00 269/8 |
| 6,361,034 B1 | * | 3/2002 | Wolfe | B25B 1/2463 269/247 |

(Continued)

FOREIGN PATENT DOCUMENTS

| | | |
|---|---|---|
| EP | 0124468 A1 | 11/1984 |
| EP | 2233684 | 9/2010 |

(Continued)

OTHER PUBLICATIONS

PCT Search Report and Written Opinion issued in connection with corresponding PCT Application No. PCT/US2014/054208 on Apr. 10, 2015.

*Primary Examiner* — Lee D Wilson

(74) *Attorney, Agent, or Firm* — Bracewell LLP; Linda L. Morgan

(57) ABSTRACT

An apparatus for guiding an anti-rotation key installation tool includes at least one magnet mounting member. A tool positioning member is coupled to the magnet mounting member and has a first end and a second end. An installation tool positioning channel extends from the first end to the second end of the tool positioning member and has an opening at the first end of the tool positioning member for accepting a portion of the anti-rotation key installation tool. At least one mechanically switchable frame securing magnet assembly is mounted to the at least one magnet mounting member for releasably securing the apparatus to an outer surface of a tubular connection.

8 Claims, 4 Drawing Sheets

(56) References Cited

U.S. PATENT DOCUMENTS

| | | | |
|---|---|---|---|
| 7,146,704 | B2 | 12/2006 | Otten et al. |
| 7,640,989 | B2 | 1/2010 | Williamson, Jr. et al. |
| 7,647,681 | B1 * | 1/2010 | Harris ..... B25B 5/061 269/17 |
| 2007/0049093 | A1 | 3/2007 | Otten et al. |
| 2007/0267196 | A1 | 11/2007 | Mondelli et al. |
| 2009/0173500 | A1 | 7/2009 | Orban et al. |
| 2011/0174500 | A1 | 7/2011 | Davies et al. |
| 2011/0259594 | A1 | 10/2011 | Rosen |
| 2012/0261114 | A1 | 10/2012 | Shoyhetman |
| 2013/0000884 | A1 | 1/2013 | Linklater |
| 2013/0025883 | A1 | 1/2013 | Robertson et al. |
| 2013/0126188 | A1 | 5/2013 | Quitberg |
| 2013/0146305 | A1 | 6/2013 | Dupal et al. |
| 2015/0074979 | A1 * | 3/2015 | Bell ..... B25B 27/04 29/468 |

FOREIGN PATENT DOCUMENTS

| | | |
|---|---|---|
| WO | 2008034166 A1 | 3/2008 |
| WO | 2012027637 | 3/2012 |

* cited by examiner

MAGNETIC FRAME AND GUIDE FOR ANTI-ROTATION KEY INSTALLATION

BACKGROUND OF TOE INVENTION

1. Field of Invention

The present disclosure relates to limiting the relative rotation of tubular member connections. The disclosure farther relates to a device for installing an anti-rotation key for preventing such rotation in oil and gas industry applications.

2. Description of Prior Art

Some oil and gas wells have several strings of casing of differing diameters cemented in the well. Each easing string is usually made up of joints of pipe having threaded ends secured together. Normally, tire operator relies on the friction of the made-up joint preventing the threaded connectors from loosening while running the string into the well. With larger diameter casing, for example, from 16 inch to 36 inch, the friction of the made-up connector may be inadequate to prevent loosening while running the casing. Securing together other types of tabular members may be accomplished in a similar manner.

In the past, operators have employed anti-rotation keys to prevent loosening, or relative rotation of tubular connections. In one type of such anti-rotation system, a rectangular pocket or slot is machined on the outer surface of the male connector. The female connector has an annular inner wall that surrounds the portion of the male connector containing the pocket. After making up the connector, the workers will drive an anti-rotation key axially into the pocket. The anti-rotation key has a slightly greater thickness than the distance irons the base of the pocket to the inner wall, resulting in an interference fit. Normally, the workers drive the anti-rotation key into place with a hammer. In other designs, a box slot extends through a side wall of the female connector adjacent the internal threads. An anti-rotation key is forced radially through the box slot after the tubular connection is fully made up. A pin slot may be formed in the male connector adjacent the external threads and the anti-rotation key may be forced into the pin slot.

Whether a radially or axially set anti-rotation key, the operator has to apply force with a hammer or other impact tool to set the anti-rotation key. It can be difficult to control such a tool so as to precisely hit the anti-rotation key, causing safety concerns for operating personnel.

Alternative designs can require explosive powered guns which are aimed manually to set the locking mechanism. This alternative also can create safety concerns for operating personnel. Another alternative design requires drilling a hole for the locking member after the tubular connection is made up. Drilling can result in metal shavings falling down the tubular string. If disconnected and then reconnected, it may be necessary to drill another hole, and that hole may overlap the previously drilled hole, limiting the locking capacity. In yet other prior art designs, unique specialty anti-rotation keys require unique specialty tools to install the locking mechanism. A prior art design using unique anti-rotation keys would not be usable for multiple anti-rotation key designs, nor could it be used in retrofitting situations. In yet other prior art designs, material must be machined out in the connectors to allow space for the installation tool. This reduction in material could affect the integrity of the connection and reduce the size and capacity of the anti-rotation key.

With any of the designs discussed above, another concern is that the anti-rotation keys fall from the grip of the operator and into the well. It can be challenging for personnel to hold an anti-rotation key in place while attempting to guide a sledge hammer or other impact tool to hit the anti-rotation key with sufficient force to set it.

It would be desirable to have an apparatus and method for installing anti-rotation keys that addresses the concerns of the prior art; one that improves the safety and efficiency of the installation of anti-rotation keys, can be used for multiple anti-rotation key design and configurations, can allow for larger, higher capacity anti-rotation keys, and reduces the risk of anti-rotation keys being dropped during the installation process. The apparatus and method of the embodiments of this disclosure address these concerns.

In certain embodiments, an apparatus for guiding an anti-rotation key installation tool includes at least one magnet mounting member. A tool positioning member is coupled to the magnet mounting member and has a first end and a second end. An installation tool positioning channel extends from the first end to the second end of the tool positioning member and has an opening at the first end of the tool positioning member for accepting a portion of the anti-rotation key installation tool. At least one mechanically switchable frame securing magnet assembly is mounted to the at least one magnet mounting member for releasably securing the apparatus to an outer surface of a tabular connection.

In certain embodiments, an anti-rotation key recess is located at the second end of the tool positioning member. The tool positioning member can include at least one key securing magnet for maintaining the position of an anti-rotation key within foe anti-rotation key recess. In other embodiments, the magnet mounting member can include a first and second vertical member and the tool positioning member can be fixed to a top end of each of the first and second, vertical members. The tool positioning member can also include a tool striking block positioned within the tool positioning channel. In yet other embodiments, the frame securing magnet assemblies have an inner shaped face for contacting art outer surface of the tubular connection. Rubber members can be positioned the inner shaped face of each of the frame seeming magnet assemblies.

In alternative embodiments of the current disclosure, a system for installing an anti-rotation device in a tubular connection includes a guide frame comprising at least two frame vertical members. At least one frame securing magnet is mounted to the guide frame that is selectively magnetically coupled to a surface of the tubular connection. A tool positioning member is mounted to the guide frame, the tool positioning member having a first end, a second end, and a tool positioning channel extending between the first and second ends. An anti-rotation key is located in the tool positioning channel at the second end of the tool positioning member. A portion of an installation tool is positioned within the first end of the tool positioning member.

In certain embodiments, the frame securing magnets are mechanically switchable magnets with a switch moveable between an off position and an on position such that when the switch is moved to the on position, the frame securing magnet is activated and when the switch is moved to the off position, the frame securing magnet is deactivated. A tool striking block can be located proximal to the anti-rotation key recess. At least one key securing magnet can maintain the position of the anti-rotation key within the anti-rotation key recess. The guide frame can be formed from a non-magnetic material.

In yet other embodiments of the current disclosure, a method for installing an anti-rotation key in a tubular connection includes retaining the anti-rotation key in a guide frame assembly. The guide frame assembly is magnetically coupled on the tubular connection and the anti-rotation key is pushed into the tubular connection with an installation tool.

In certain embodiments, the anti-rotation key is positioned in the guide frame assembly. The anti-rotation key can be pushed in an axial direction relative to the tubular connection or in a radial direction relative to the tabular connection. In other embodiments the guide frame assembly can be decoupled from the tubular connection. Decoupling the guide frame assembly from the tubular connection can be accomplished by deactivating a magnet.

In yet other embodiments, the tool positioning portion includes a tool striking block and the anti-rotation key is pushed into the tubular connection by contacting the tool striking block with the installation tool. The anti-rotation key can be positioned in a recess of the guide frame assembly and the position of the anti-rotation key can be maintained in the anti-rotation recess with at least one key securing magnet.

BRIEF DESCRIPTION OF DRAWINGS

Same of the features and benefits of the present invention having been stated, others will become apparent as the description proceeds when taken in conjunction with the accompanying drawings, in which.

Figure 1:
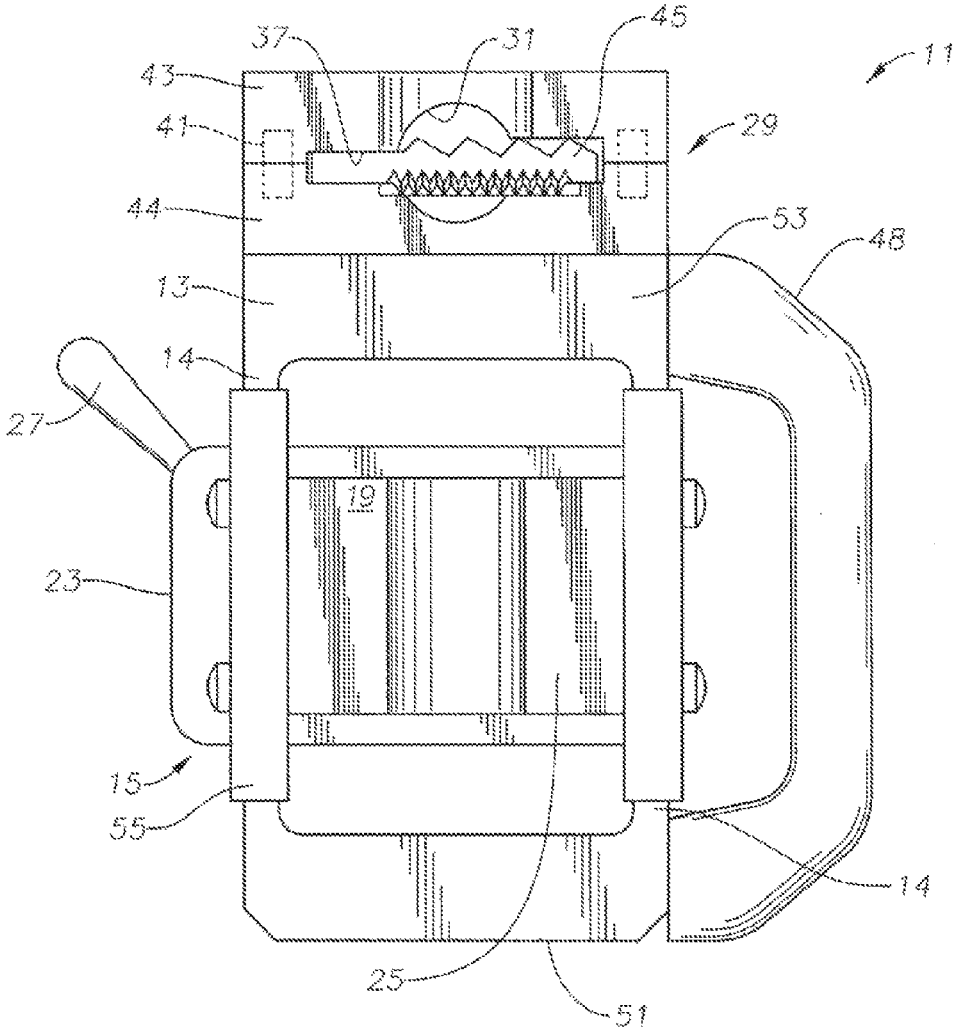
FIG. 1 is an elevation view of a guide frame assembly with the anti-rotation key positioned in the guide frame assembly in accordance with this disclosure.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled, in the art. In the drawings and specification, there have been disclosed illustrative embodiments and, although specific terms are employed, they are used in a generic and descriptive sense only and not for the purpose of limitation.

Referring to FIG. 1, an example of a guide frame assembly 11 is shown that includes a guide frame 13. Guide frame 13 can be made from any material that can be formed into the required shape and withstand the forces applied during the anti-rotation key installation process. In some embodiments, guide frame 13 is made from a non-magnetic material such as stainless steel. Guide frame assembly 11 also includes at least one frame securing magnet assembly 15. In this configuration, guide frame 13 includes two vertical members 14. Vertical members 14 are generally parallel elongated flat bars which are structurally joined at a bottom end 51 of guide frame 13 and at a top end 53 of guide frame 13. Bottom end 51 and top end 53 are located opposite each other and generally perpendicular to vertical members 14.

Guide frame 13 can have predrilled holes 17 and each frame securing magnet assembly 15 can have internally threaded openings. Screws 21 can be located through holes 17 and screwed into the internally threaded openings to secure each magnet assembly 15 to guide frame 13. Alternative connection methods, such as bolts, welds and other similar means known to those in the arts can be used to secure each magnet assembly 15 to guide frame 13. In the embodiment of FIG. 1, vertical members 14 act as magnet mounting members, and each magnet assembly 15 is mounted to vertical members 14 of guide frame 13.

Figure 3:
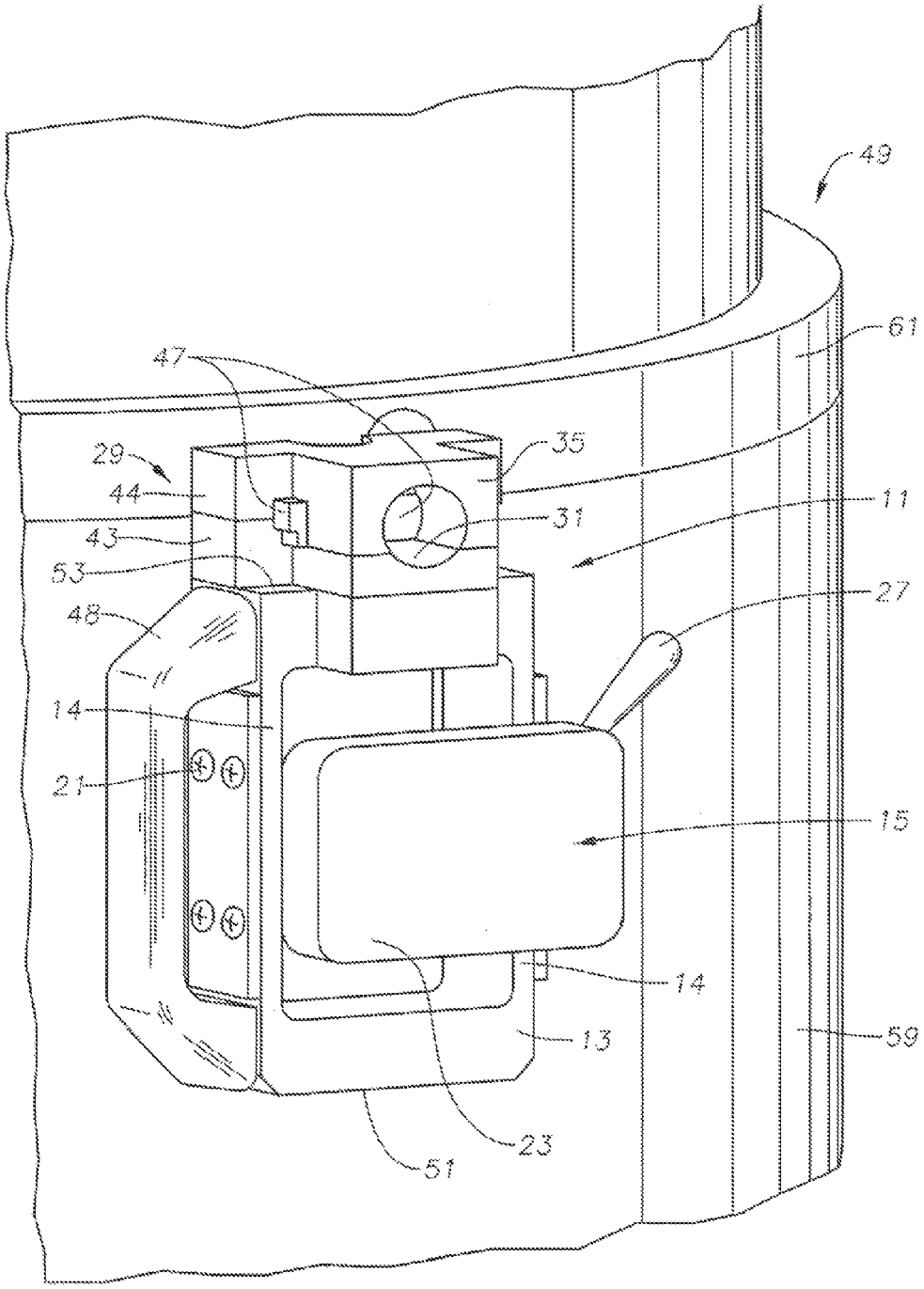
FIG. 3 is a perspective view of the guide frame assembly and anti-rotation key of FIG. 1, with the guide frame assembly secured to a tubular connection.

Each frame securing magnet assembly 15 can include a top portion 23 which supports a base portion 25. In an example, base portion 25 includes a powerful mechanically switchable holding magnet with hundreds of pounds of holding capacity. For example, the base portion 25 of each magnet assembly 15 can have 100 lbs to 1000 lbs of holding capacity. Top portion 23 is connected to base portion 25. Top portion 23 can be a generally rectangular shaped block. Base portion 25 can also be a generally rectangular shaped block with an outer flat face that mates with a larger inner flat lace of top portion 23. An inner shaped face 19 of base portion 25 can be shaped to mate with a surface of a tubular connection 49 (FIG. 3). Top portion 23 can also include a mechanical switch 27. Mechanical switch 27 is moveable between an off position and an on position so that the magnetic holding capacity of base portion 25 can be turned off and on. When turned to the on position, the magnetic holding capacity of base portion 25 is activated and when turned to the off position, the magnetic holding capacity of base portion 25 is deactivated. As opposed to an electromagnet, the magnetic field of the mechanically switchable magnet of base portion 25 can be turned off and on with no power supply required.

Figure 4:
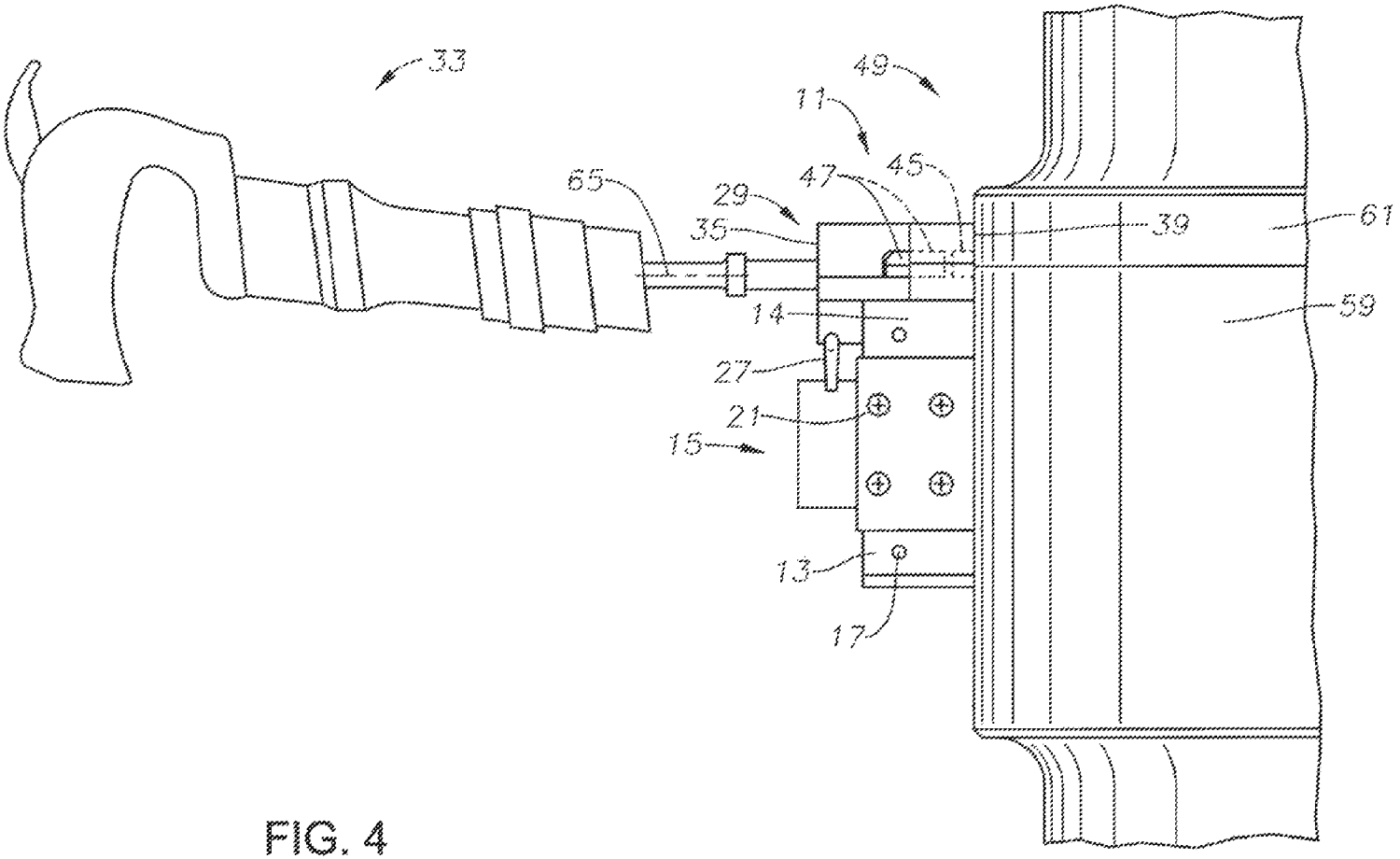
FIG. 4 is an elevation view of the guide frame assembly and anti-rotation key of FIG. 1, with the guide frame assembly secured to a tabular connection and a portion of an installation tool positioned in the guide frame assembly.

Guide frame 13 also includes a tool positioning member 29 located at the top end 53. Tool positioning member 29 is sized for guiding an anti-rotation key installation tool 33 (FIG. 4). Tool positioning member 29 can include a tool positioning channel 31 which runs from a first end 35 (FIG. 2) of tool positioning member 29 to a second end 39 of tool positioning member 29, through which the installation tool 33 (FIG. 4) can be positioned. Installation tool 33 is inserted through an open end of positioning channel 31 at the first end 35 of tool positioning member 29. Positioning channel 31 can have a cross sectional shape at the first end 35 to accommodate and guide installation tool 33, such as circular, oblong, rectangular, or a combination thereof.

Figure 2:
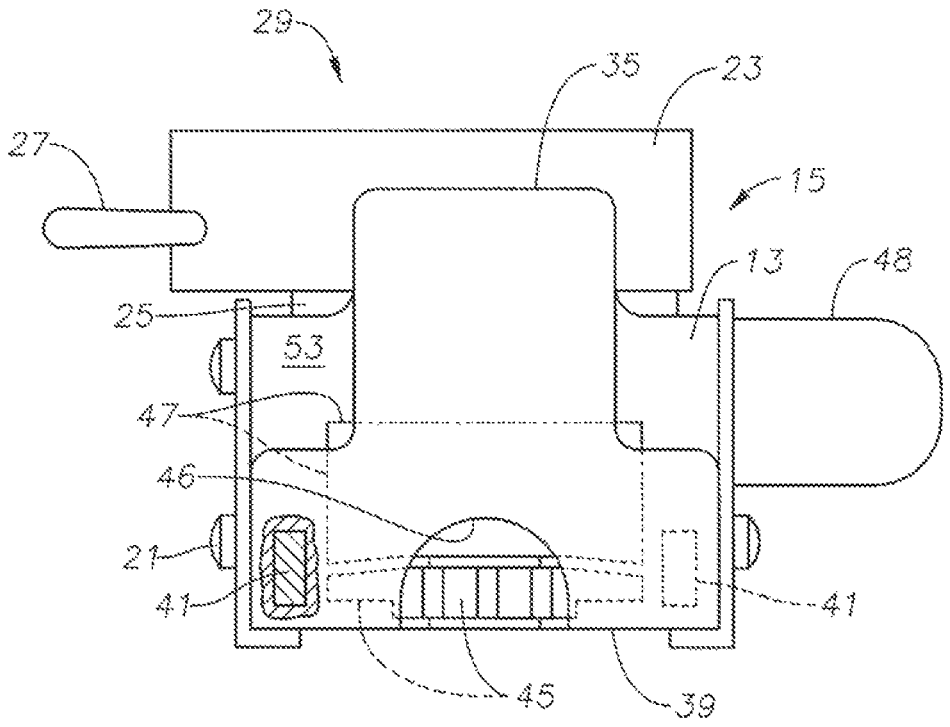
FIG. 2 is a plan view of the guide frame assembly and anti-rotation key of FIG. 1, shown from the top end, with a portion cut away to show a magnet.

Guide frame assembly 11 can also include an anti-rotation key recess 37. Key recess 37 is located within the tool positioning channel 31 at the second end 39 (FIG. 2) of tool positioning member 29. Turning to FIGS. 2 and 3, tool positioning member 29 can also include one or more key securing magnets 41. Key securing magnets 41 can maintain the position of an anti-rotation key 45 within the key recess 37 until the anti-rotation key 45 is ready to be inserted into the tubular connection 49. Key securing magnets 41 can foe captured between an upper body portion 43 and a lower body portion 44 of tool positioning member 29. In alternative embodiments, key securing magnets 41 can be captured magnets located within a single body of the tool positioning member. In other alternative embodiments, tool positioning member can have alternative means of maintaining the position of anti-rotation key 43 in key recess 37, such as horizontal or vertical holts, or a combination thereof. Anti-rotation key 45 will be sized and shaped to prevent loosening, or relative rotation of tubular connection 49. Anti-rotation key 45 can have tapered load shoulders on a top side and serrated protrusions on an opposite bottom side.

Tool positioning member 29 can also have a notch 46 located on upper body portion 43 adjacent to its second end 39. This notch 45 can have a generally semi-circular cross section and extend through the upper body portion 43 from its top surface to the key recess 37 and allows for the operator to visualize anti-rotation key 45 to determine if it is correctly positioned within key recess 37. Notch 46 can also assist with visual alignment of the anti-rotation key 45 with the tubular connection 49 (FIG. 4).

A tool striking block 47 can be located within tool positioning member 29 in the tool positioning channel 31 between the first end 35 of tool positioning member 29 and the second end 39 of tool positioning member 29. The tool striking block 47 will be positioned proximal to the key recess 37 and closer to the first end 35 of the tool positioning member 29 than the key recess 37.

The cross section of positioning channel 31 from the first end 35 to the second end 39 of tool positioning member 29 can vary. As discussed above, at the first end 35, positioning channel 31 can have a cross sectional shape to accommodate a portion of the installation tool 33. At the second end 39, it can have a cross sectional shape to accommodate the tool striking block 47, key recess 37 and anti-rotation key 45. In the embodiment of FIG. 2, the cross section of positioning channel 31 at the second 39 of tool positioning member 29 is a generally rectangular shape with a height, which is generally parallel to vertical members 14, being shorter than its width, which is generally parallel to top end 53. This rectangular shape accommodates tool striking block 47, anti-rotation key 45 and key recess 37.

Guide frame assembly 11 may have a handle 48 secured to guide frame 13 to enable an operator to easily carry guide frame assembly 11. Guide frame assembly 11 may also have rubber members 55 (FIG. 1) which are positioned along outer edges of inner shaped face 19 of base portion 25 of triune securing magnet assemblies 15. Alternatively, the rubber members 55 may be positioned on portions of guide frame 13 which come into contact with tubular connection 49 (FIG. 3).

Guide frame assembly 11 can be used to assist with the installation of anti-rotation keys 45 which are pushed in a direction generally parallel to the central axis of the tubular connection 49 or in a direction generally radial relative to the central axis of the tubular connection 49. In one example, the embodiments shown in the figures of this disclosure are more suited for use during the installation of anti-rotation keys 45 which are pushed in a direction generally radial relative to the central axis of the tubular connection 49.

Turning to FIGS. 3 and 4, tubular connection 49 includes a female connector 59 with annular inner wall that surrounds the portion of a male connector 61. In the embodiment of FIGS. 3 and 4, an anti-rotation key 45 can be pushed radially through a slot after the tubular connection 49 is fully made up. As discussed above, although the configuration of the guide frame assembly 11 shown in the figures of this application is best suited for use during the installation of anti-rotation keys 45 which are pushed in a direction generally radial relative to the central axis of the tabular connection 49, optionally, magnet assemblies 15 could be attached to another guide frame (not shown) which is instead configured to assist with the installation of anti-rotation keys 45 that are pushed in a direction generally parallel to the central axis of the tubular connection 49.

In a non-limiting example of operation, the frame securing magnet assemblies 15 are secured to magnet mounting members, which in this embodiment are vertical members 14 of guide frame 13. Screws 21 are shown passed through holes 17 in the guide frame 13 and screwed into internal threaded openings in the magnet assemblies 15 for securing magnet assemblies 15 to vertical members 14.

A striking block 47 can then be located in positioning channel 31 and then an anti-rotation key 45 can be positioned in key recess 37. The anti-rotation key 45 can be held in place by magnets 41 captured within tool positioning member 29, or other alternative anti-rotation key securing means.

Guide frame 13 would then be aligned relative to tubular connection 49 so that anti-rotation key 45 is situated in a correct position relative to the tubular connection 49 to be pushed into the slot of the tubular connection 49. Rubber members 55 will come into contact with an outer surface of tubular connection 49 to assist guide frame 13 in gripping tubular connection 49.

Magnet assemblies 15 can then be turned on by moving switch 27 to the "on" position, so that the holding capacity of magnetic base portions 25 is activated. Tubular connection 49 includes magnetic material so that activating magnet assemblies 15 causes the magnets to be magnetically attached to tubular connection 49, releasably securing the guide frame assembly 11 to tubular connection 49. In this manner, anti-rotation key 45 is held steady in the correct location for being pushed into tubular connection 49 in a hands free manner.

An installation tool 33 can be positioned in the toot positioning member 29 of guide frame 13. Installation tool 33 can be inserted through the opening at the first end 35 of positioning member 29 and fed through positioning channel 31 until it comes into contact with striking block 47. Installation tool 33 can be, for example, a pneumatic hammer. In such an embodiment, a bit of the pneumatic hammer would contact striking block 47. An operator can then activate the pneumatic hammer and use the pneumatic hammer to apply an impact force to striking block 47, which in turn impacts anti-rotation key 45, pushing anti-rotation key 45 into tubular connection 49. In some embodiments, a striking block 47 may not be utilized and instead, installation tool 33 can directly contact anti-rotation key 45, pushing anti-rotation key 45 into tubular connection 49. However, when used, striking block 47 can protect anti-rotation key 45 from damage anti-rotation key 45 might incur if anti-rotation key 45 were in direct contact with installation tool 33.

The installation tool 33 can be an alternative impact tool such as a hydraulic cylinder, modified stamping gun, explosive tool, a chisel or other suitable device. For example, if the tool was a chisel, the operator could insert the chisel into the open end at the first end 35 of positioning member 29 and through positioning channel 31 until it comes into contact with striking block 47. In such an embodiment, when a first end of installation tool 33 is positioned in the tool positioning member 29 of guide frame 13, a second end of installation tool 33 extends sufficiently far out of the first end 35 of positioning channel 31 that it can safely be struck with a sledge hammer. The operator would then strike the chisel with the sledge hammer to impact striking block 47 and push anti-rotation key 45 into tubular connection 49.

Installation tool 33 is able to move freely along positioning channel 31 along an axis 65 that extends from the first end 35 to the second end 39 of positioning member 29. However the cross sectional shape of positioning channel 31 will limit movement of installation tool 33 in other directions. The force applied to push anti-rotation key 45 into tubular connection 49 is along axis 65, a direction in which the tool 33 can move freely. Therefore the major force exerted by installation tool 33 will not act against the holding strength of magnetic base portions 25. In other words, the guide frame 13 is guiding installation tool 33, but does not secure installation tool 33 to tubular connection 49. Therefore guide frame 13 is more likely to remain secured to tubular connection 49 in the correct position while anti-rotation key 45 is being pushed into tubular connection 49. Although there may be forces along directions that are not co-linear with axis 65, the holding strength of magnetic base portions 25 can be sized to accommodate such lesser forces.

In alternative embodiments, due to the configuration of the anti-rotation key system, it may not be possible to position anti-rotation key 45 in guide frame assembly 11. In such embodiments, anti-rotation key 45 may be held in place relative to tubular connection 49 in an alternative manner, such as with shear pins or adhesive. Guide frame 13 would then be aligned relative to the tubular-connection 49 such that installation tool 33, once positioned within guide frame 13, would correctly contact anti-rotation key 45 to be able to push anti-rotation key 45 into tubular connection 49.

After anti-rotation key 45 is pushed into tubular connection 49, magnet assemblies 15 can be deactivated. This can be accomplished, for example, by turning the mechanical switch 27 to the off position. Once the guide frame assembly 11 is removed from tubular connection 49, it can be reused for assisting to install an anti-rotation key 45 in a similar tubular connection, such as to install another anti-rotation key 45 in the same tubular connection 49 or install an anti-rotation key 45 in the next tubular connection 49 of the same pipe string. Guide frame assembly 11 could also be easily transported and used to install a variety of different anti-rotation keys in other tubular connections.

The terms "vertical", "horizontal", "upward", "downward", "above", and "below" are used herein only for convenience because guide frame assembly 11 may be utilized in various positions.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. An apparatus for guiding an anti-rotation key installation tool in a tubular connection, the apparatus comprising:

a guide frame having at least one magnet mounting member;

a tool positioning member coupled to the guide frame and having a first end and a second end;

an installation tool positioning channel extending from the first end to the second end of the tool positioning member with an opening at the first end of the tool positioning member for accepting a portion of the anti-rotation key installation tool and an anti-rotation key recess located at the second end of the tool positioning member, the anti rotation key recess sized to house an anti-rotation key for installation in the tubular connection by the anti-rotation key installation tool; and at least one switchable frame securing magnet assembly mounted to the at least one magnet mounting member for releasably securing a face of the frame securing magnet assembly of the apparatus to an outer surface of the tubular connection, and wherein the tool positioning channel extends in a direction generally normal to the face of the frame securing magnet assembly so that when the face of the frame securing magnet assembly is releasably secured to the outer surface of the tubular connection, the anti-rotation key recess is proximate to the tubular connection and the second end of the tool positioning member faces in a direction generally away from the tubular connection.

2. The system of claim 1, wherein the tool positioning member further comprises at least one key securing magnet for maintaining the position of the anti-rotation key within the anti-rotation key recess.

3. The apparatus of claim 1, wherein the guide frame has a first and second vertical member and the tool positioning member is fixed to a top end of each of the first and second vertical members.

4. The apparatus of claim 1, wherein the tool positioning member further comprises a tool striking block positioned within the tool positioning channel.

5. The apparatus of claim 1, wherein each of the at least one frame securing magnet assembly has an inner shaped face for contacting an outer surface of the tubular connection, the apparatus further comprises rubber members positioned the inner shaped face of each of the at least one frame securing magnet assembly.

6. The apparatus of claim 1, wherein the frame securing magnet assembly is a mechanically switchable magnet with a switch moveable between an off position and an on position such that when the switch is moved to the on position, the at least one frame securing magnet assembly is activated and when the switch is moved to the off position, the at least one frame securing magnet assembly is deactivated.

7. The system of claim 1, wherein the tool positioning member further comprises at least one key securing magnet for maintaining the position of the anti-rotation key within the anti-rotation key recess.

8. The system of claim 1, wherein the magnet mounting member is formed from a non-magnetic material.

* * * * *